US007374464B1

(12) United States Patent
Vicenza et al.

(10) Patent No.: US 7,374,464 B1
(45) Date of Patent: May 20, 2008

(54) QUICK CONNECTION BATTERY TERMINAL

(75) Inventors: Aguinaldo Vicenza, Braganca Paulista/SP (BR); Pedro LaMartine de Faria, Braganca Paulista/SP (BR); Djalma Adelino de Oliveira, Braganca Paulista (BR)

(73) Assignee: Tyco Electronics Brasil Ltda., Sao Paul (BR)

( * ) Notice: Subject to any disclaimer, the term of this patent is extended or adjusted under 35 U.S.C. 154(b) by 0 days.

(21) Appl. No.: 11/774,283

(22) Filed: Jul. 6, 2007

(51) Int. Cl.
*H01R 4/40* (2006.01)

(52) U.S. Cl. ..... 439/769; 439/773

(58) Field of Classification Search ..... 439/754, 439/756, 757, 761, 763, 769, 773
See application file for complete search history.

(56) References Cited

U.S. PATENT DOCUMENTS 3,529,281 A * 9/1970 Martinez et al. ..... 439/726
5,389,466 A * 2/1995 Inoue et al. ..... 429/178
6,971,925 B1 * 12/2005 Orange ..... 439/773
7,189,122 B2 3/2007 Freitag
7,303,448 B1 * 12/2007 Sproesser ..... 439/773
2001/0053639 A1 * 12/2001 Endo ..... 439/773

* cited by examiner

*Primary Examiner*—Tho D. Ta

(57) ABSTRACT

A battery terminal including a base configured to selectably engage a terminal tongue. An annular electrode-engaging portion is configured to receive a battery post, one end of the electrode-engaging portion extending contiguously from the base. An opposite end of the electrode-engaging portion terminates at a nonplanar member adjacent to the base. A lever-holding portion extends from the base toward the nonplanar member. A lever is pivotably connected to the lever-holding portion about an axis, the lever having a cam-shaped portion. In response to pivotal motion of the lever toward a closed position, the cam-shaped portion is urged into contact with the nonplanar member, the nonplanar member pivoting about an end along the base to resiliently draw the electrode-engaging portion into a gripping arrangement for engagement with the battery post.

20 Claims, 7 Drawing Sheets

QUICK CONNECTION BATTERY TERMINAL

FIELD OF THE INVENTION

The present invention relates generally to electrical connectors, more particularly, to battery terminal connectors.

BACKGROUND OF THE INVENTION

Automobile engine compartments contain many components which substantially fill the compartment, making routine maintenance a challenge. One such component is the battery. Batteries typically are extremely heavy and have fixed positive and negative charged locations, often in the form of exterior extending posts for interconnection with corresponding connectors, usually referred to as battery terminals. Conventional battery terminals typically include threaded fasteners that must be actuated to draw the battery terminal into engagement with the corresponding battery post. Typically, a corresponding electrical cable is crimped onto each battery terminal representing an in-line orientation, which may or may not be the most convenient orientation for engaging the battery post. In addition, it may be desirable to add components requiring electrical power to a vehicle, the components including with electrical terminals having terminal tongues. It is also desirable to not disturb the electrical connection or engagement between the battery terminal and the cables associated with starting the automobile, preserving the electrical connection therebetween. Unfortunately, current battery terminal constructions are not configured to modify the electrical connection with other components, i.e., separate electrical terminal tongues, without discontinuing the electrical connection between the vehicle starting cables.

What is needed is a battery terminal construction that does not require special tools to provide electrical connections to a battery. What is also needed is a battery terminal construction configured to separately receive terminal tongues.

SUMMARY OF THE INVENTION

The present invention relates to a battery terminal comprising a base configured to selectably engage a terminal tongue. An annular electrode-engaging portion is configured to receive a battery post, one end of the electrode-engaging portion extending contiguously from the base. An opposite end of the electrode-engaging portion terminates at a nonplanar member adjacent to the base. A lever-holding portion extends from the base toward the nonplanar member. A lever is pivotably connected to the lever-holding portion about an axis, the lever having a cam-shaped portion. In response to pivotal motion of the lever toward a closed position, the cam-shaped portion is urged into contact with the nonplanar member, the nonplanar member pivoting about an end along the base to resiliently draw the electrode-engaging portion into a gripping arrangement. This gripping engagement will provide an electrical connection with the battery post.

The present invention further relates to a battery terminal comprising a base configured to separately engage at least two terminal tongues. An annular electrode-engaging portion receives a battery post, one end of the electrode-engaging portion extending contiguously from the base. An opposite end of the electrode-engaging portion terminates at a nonplanar member adjacent to the base. A lever-holding portion extends from the base toward the nonplanar member. A lever is pivotably connected to the lever-holding portion about an axis, the lever having a cam-shaped portion. In response to pivotal motion of the lever toward a closed position, the cam-shaped portion is urged into contact with the nonplanar member, the nonplanar member pivoting about an end along the base to resiliently draw the electrode-engaging portion into a gripping arrangement.

An advantage of the present invention is that the battery terminal can be connected to a battery post without special tools.

A further advantage of the present invention is that the battery terminal construction is configured to separately receive at least two terminal tongues.

A still further advantage of the present invention is that the battery terminal construction is configured to separately receive terminal tongues at different predetermined angular orientations from the battery terminal construction.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
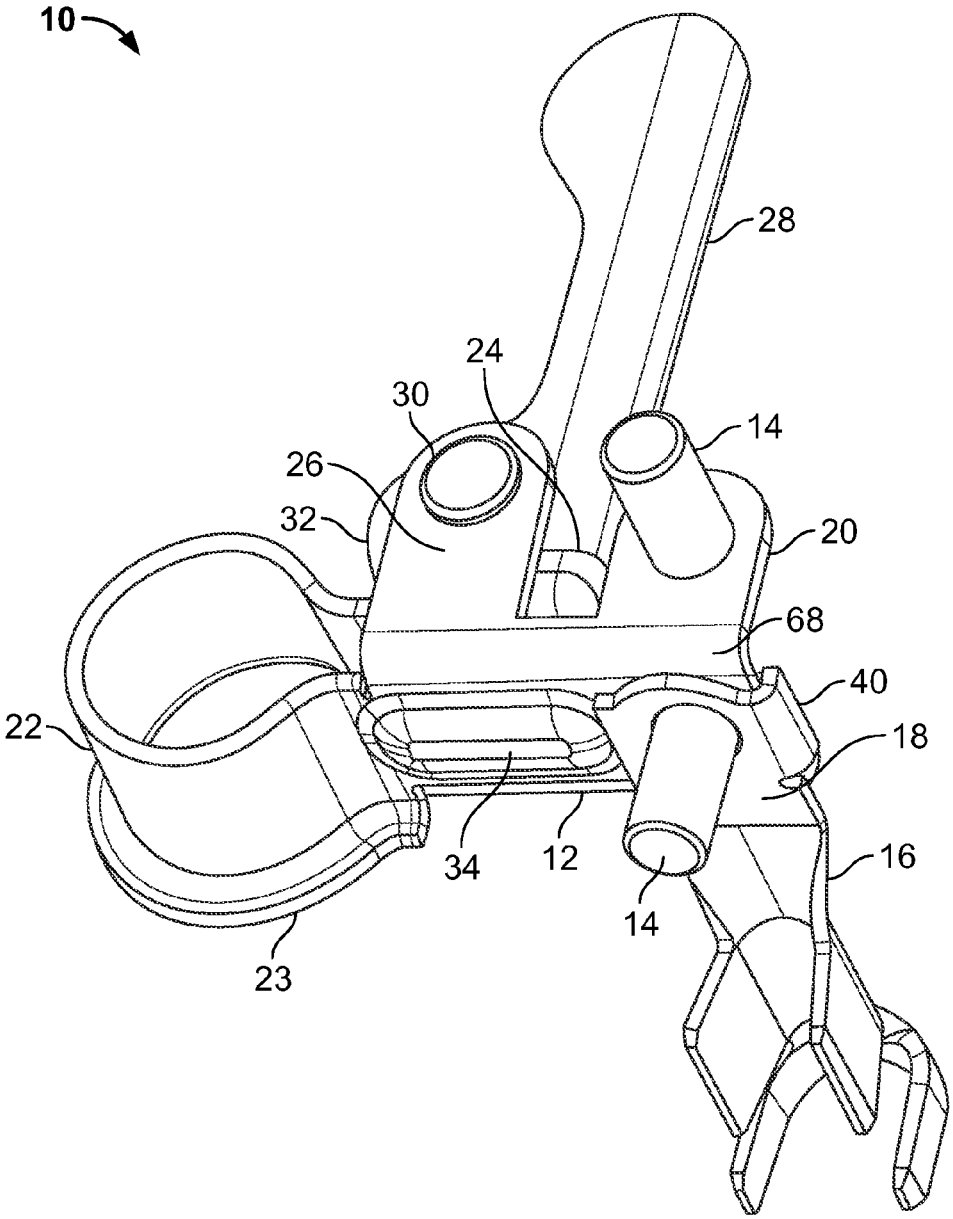
FIG. 1 is a top perspective view of an embodiment a battery terminal of the present invention.
Figure 7:
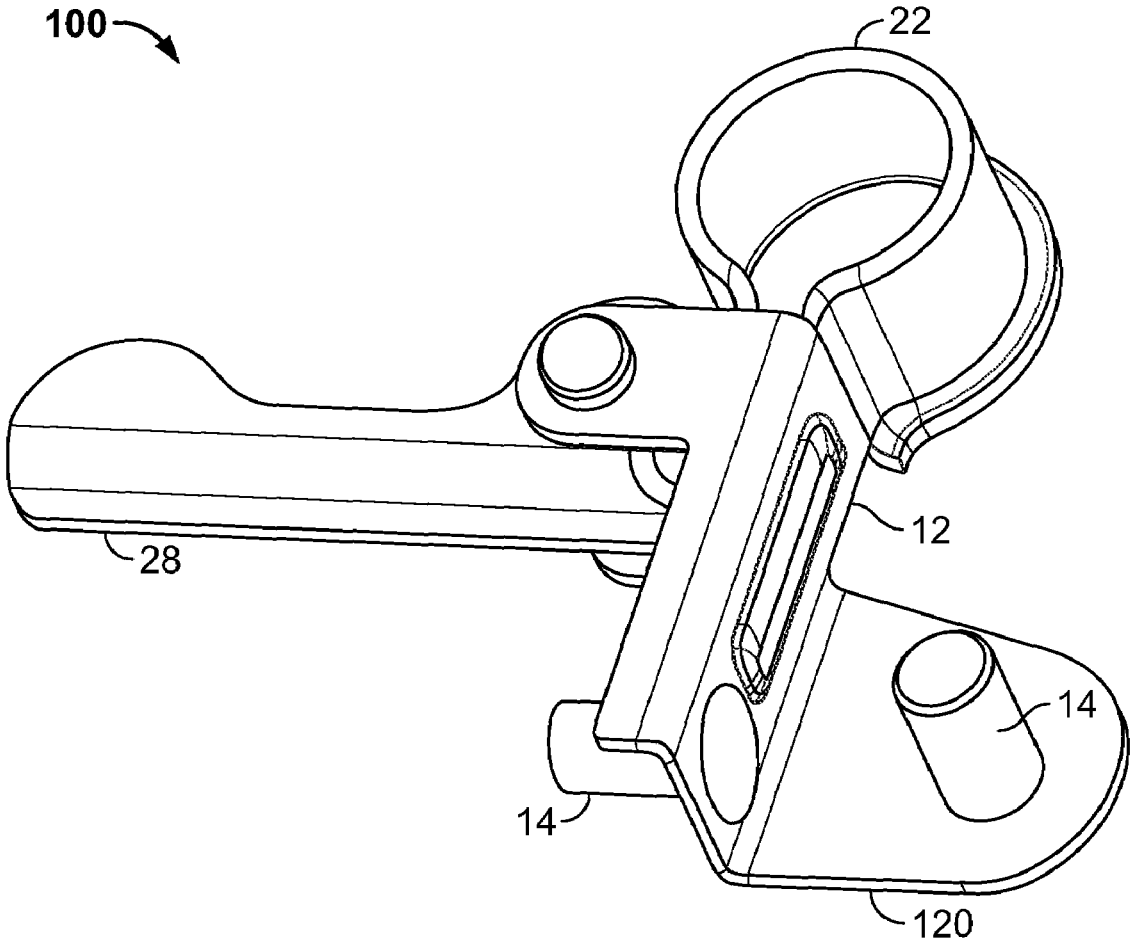
FIG. 7 is a top perspective view of an alternate embodiment a battery terminal of the present invention.

Referring to FIGS. 1 and 7 are embodiments of battery terminal 10, 100 according to the present invention for use with providing an electrical connection or engagement with posts of a battery (not shown). Not only can the electrical connection be effected without a special tool, but also can selectively engage a terminal tongue of at least two terminals. That is, selectively connect/disconnect a terminal tongue of one terminal without disturbing the electrical connection of another terminal tongue.

Figure 5:
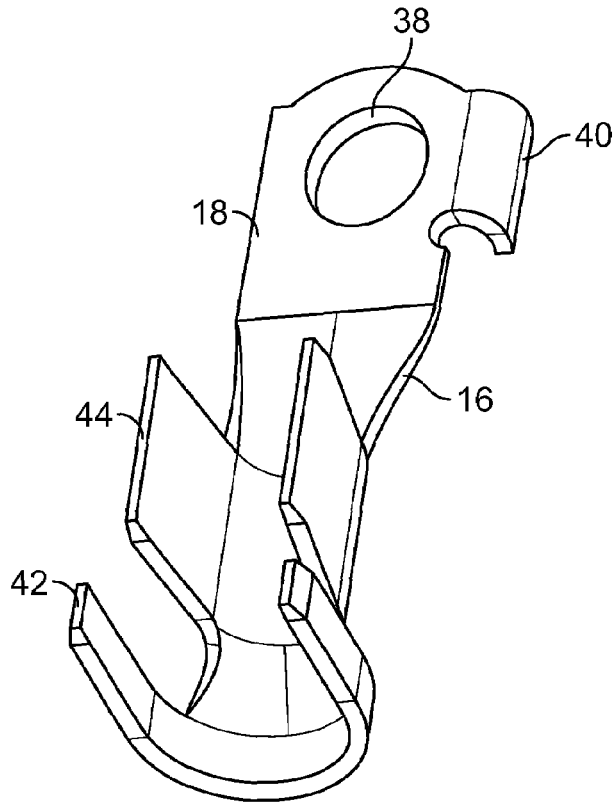
FIG. 5 is a bottom perspective view of an embodiment of a terminal of the present invention.

As used herein, the term terminal tongue refers to a portion of a terminal that is engaged to provide an electrical connection between the terminal and the battery terminal. In one embodiment, such as shown in FIG. 5, a tongue 18 includes an aperture 38 formed therein to receive a protruding component, such as a pin or a fastening member 14 (see FIG. 1) extending from base 12 of battery terminal 10.

Fastening member 14 can include, but is not limited to, a pin, threaded member, or other construction, and can include any protrusion or other structural arrangement or configuration usable to selectably receive and secure a terminal tongue. Alternately, a feature, such as a slot (not shown) can be formed in the tongue or other feature that similarly provides an electrical connection between the tongue and the battery terminal. Also as used herein, the term battery post is intended to refer to a protrusion extending from a battery that corresponds to one of the charged, i.e., positive or negative, portions of the battery. In one embodiment, a battery post resembles a cylindrical segment having an outside surface such that when engaged with an inside surface of an electrode-engaging portion 22 (FIG. 1) of battery terminal 10, as discussed in additional detail below, an electrical connection is formed between the electrode-engaging portion and the battery post.

Figure 2:
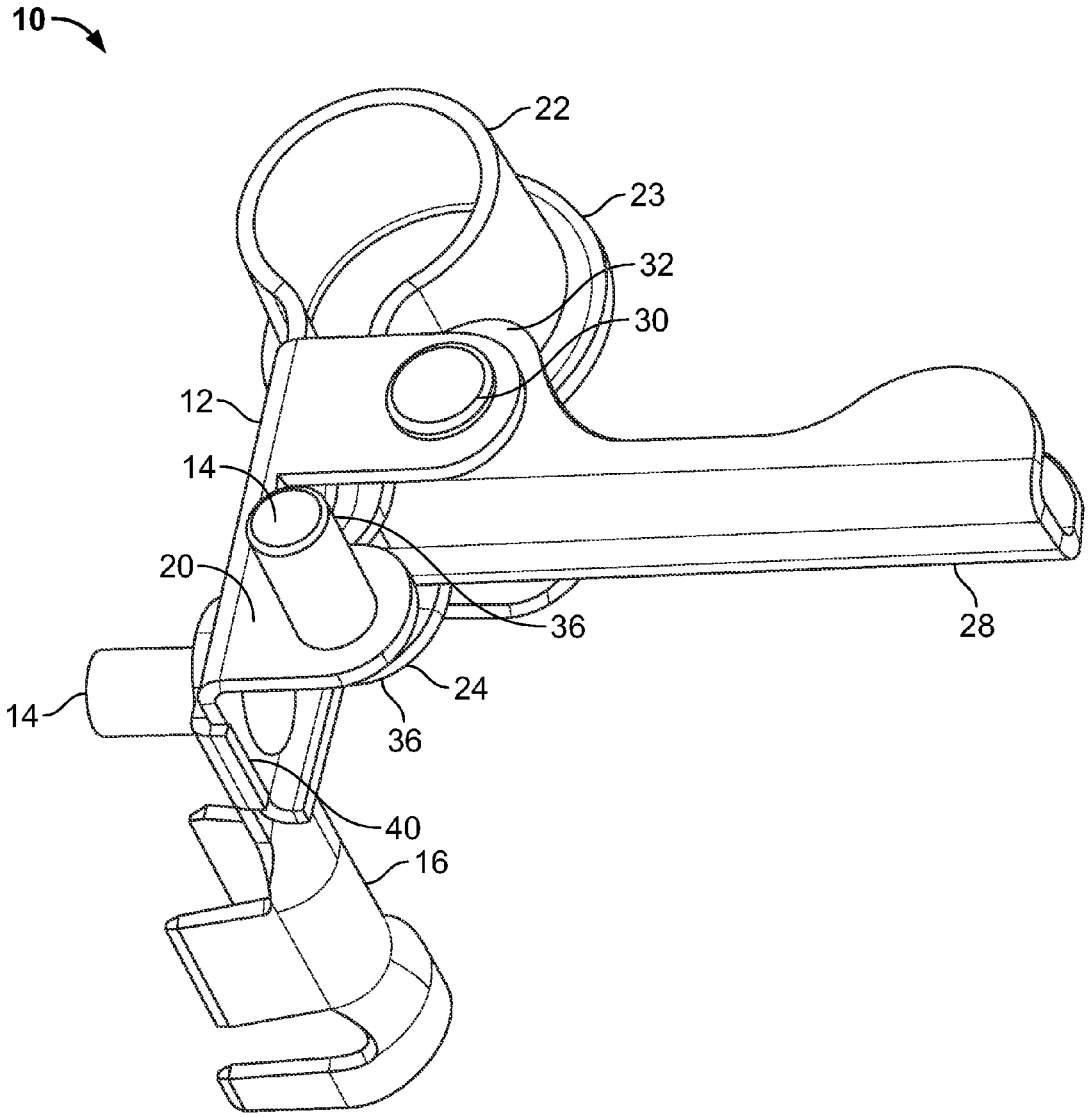
FIG. 2 is the top perspective view of the embodiment a battery terminal of the present invention of FIG. 1 rotated clockwise 90 degrees about a vertical axis.
Figure 3:
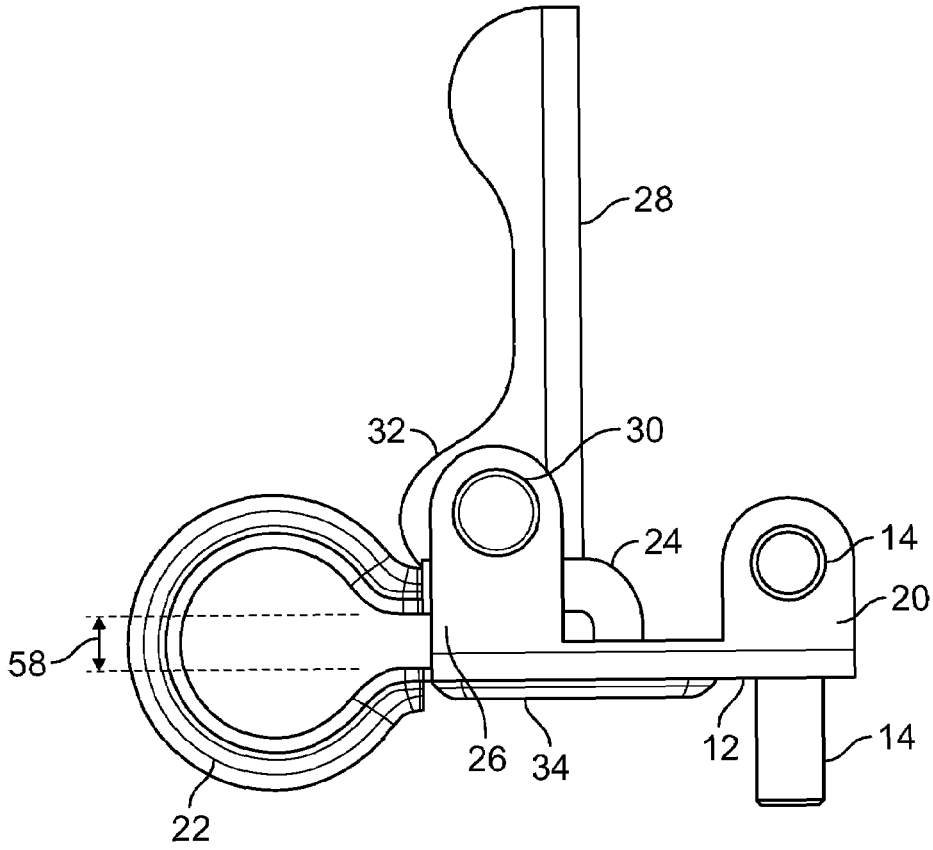
FIG. 3 is a plan view of an embodiment of a battery terminal of the present invention in an open position.
Figure 4:
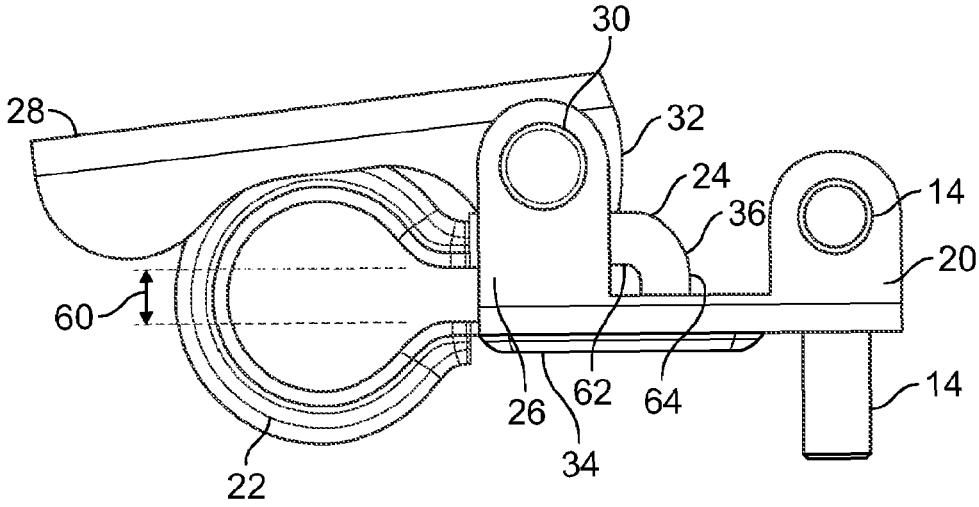
FIG. 4 is a plan view of an embodiment of a battery terminal of the present invention in a closed position.
Figure 9:
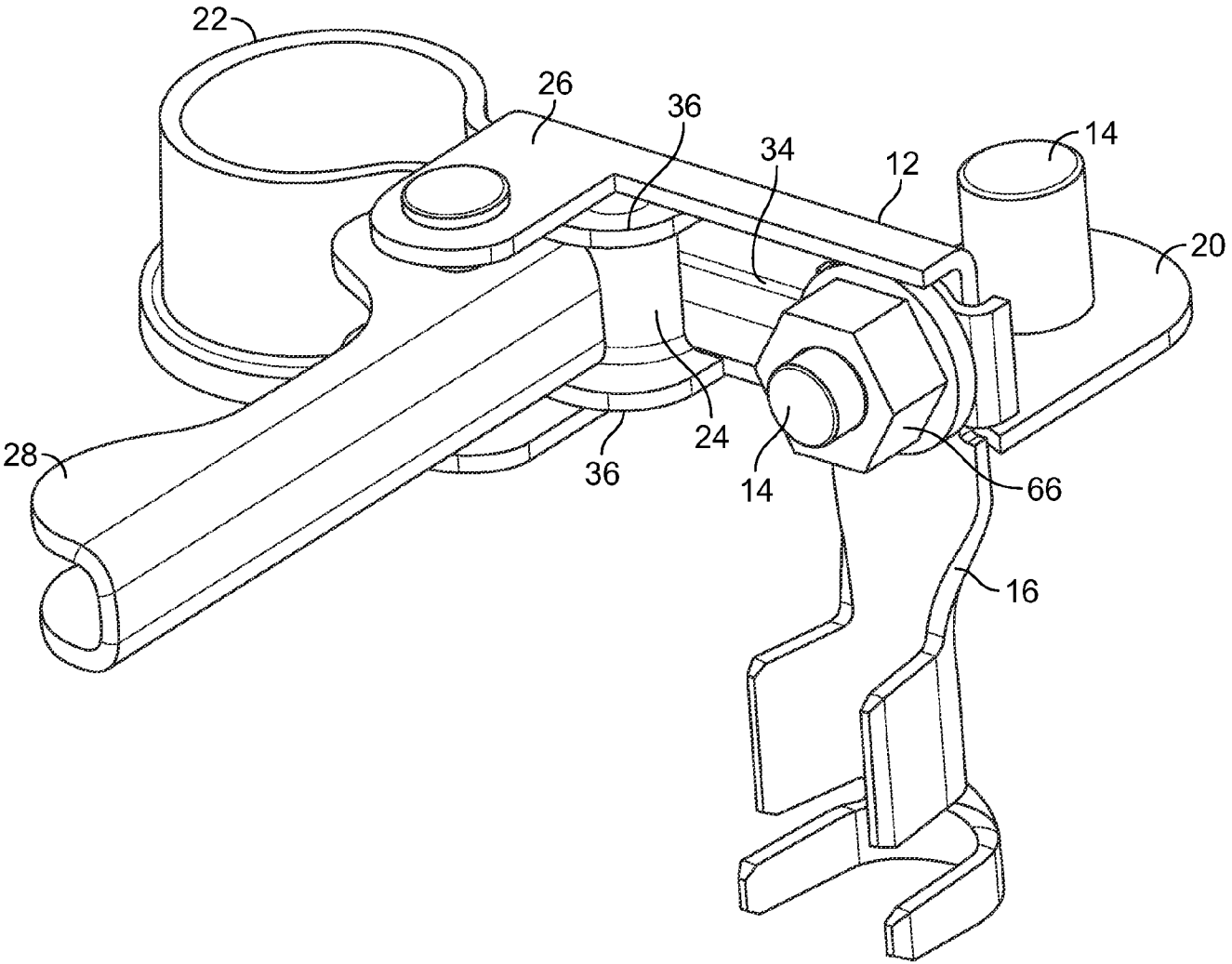
FIG. 9 is a top perspective view of an alternate embodiment a battery terminal of the present invention of FIG. 7 rotated counterclockwise 90 degrees about a vertical axis.

As shown in FIGS. 1-4, battery terminal 10 includes a base 12 extending to electrode-engaging portion 22 having a closed geometry, such as an annular shape, for engaging a battery post (not shown). As shown, one end of electrode-engaging portion 22 extends contiguously from base 12. The opposite end of electrode-engaging portion 22 terminates at a nonplanar member 24 disposed adjacent to base 12. To ease installation over a battery post, electrode-engaging portion 22 includes a tapered profile, and as shown in FIG. 1, a tapered region 23 along the larger end of electrode-engaging portion 22. In one embodiment, nonplanar member 24 includes a curved portion, although as shown in FIG. 4, nonplanar member 24 includes segment 62 and segment 64 (see FIG. 4) disposed at an angle to each other, such as 90 degrees. In two different embodiments, as shown in FIGS. 2 and 9, nonplanar member 24 includes opposed flanges 36 disposed on each side of a cam-shaped portion 32 of a lever 28. Flanges 36 provide nonplanar member 24 with substantial structural strength and stiffness, which is not contained in known art constructions, and that assists with engaging a battery post. In one embodiment, nonplanar member 24 provides sufficient resilience for electrode-engaging portion 22 to selectably release the battery post in response to the lever 28 being actuated from a closed position (FIG. 4) to an open position (FIG. 3), which is not contained in known art constructions.

It is to be understood that components of the battery terminal are of sufficient structural strength and electrical conductivity to effect an electrical connection when engaged with a battery post, such as metal, including, but not limited to brass or steel. Although the component material is typically electrically conductive, electrically conductive coatings, such as tin, or other materials may also be used.

Base 12 further includes a lever-holding portion 26, such as opposed tabs, through which lever-holding portion 26 secures a pin 30 having an axis. Lever 28 is pivotably connected to cam-shaped portion 32 by pin 30 so that lever 28 rotates about the axis of pin 30. As further shown in FIGS. 3 and 4, nonplanar member 24 is disposed between base 12 and cam-shaped portion 32 of lever 28. FIG. 3 shows battery terminal 10 in an open position, or prior to engagement with a battery post, and FIG. 4 shows battery terminal 10 in a closed position, or after engagement with a battery post. In the open position as shown in FIG. 3, a distance 58 separates base 12 from an adjacent surface of nonplanar member 24, with lever 28 disposed substantially perpendicular to base 12. To achieve the closed position as shown in FIG. 4, lever 28 is pivotably rotated about the axis of pin 30 toward electrode-engaging portion 22, typically until lever 28 abuts electrode-engaging portion 22. During rotation of lever 28, cam-shaped portion 32 increasingly urges nonplanar member 24 into movement with respect to base 12. In one embodiment, flanges 36 (FIG. 2) provide substantial rigidity to nonplanar member 24. That is, in response to abutting contact with cam-shaped portion 32, nonplanar member 24 is substantially rigid; the end of nonplanar member 24 opposite electrode-engaging portion 22 pivots along base 12, reducing distance 58 (FIG. 3) to distance 60 (FIG. 4) to draw electrode-engaging portion 22 into engagement with the battery post. In one embodiment, nonplanar member 24 is substantially rigid due to the opposed flanges 36, which defines a C-shape having significant structural rigidity. Alternately, nonplanar member 24 may have increased thickness, as compared to electrode-engaging portion 22, or contain an embossed region or regions similar to embossed region 34 (see FIG. 1) to achieve increased rigidity as compared to the electrode-engaging portion, which nonplanar member is not contained in known art constructions.

In one embodiment, nonplanar member 24 enhances resilient behavior of electrode-engaging portion 22 in response to lever 28 being pivotably actuated from the closed position (FIG. 4) to the open position (FIG. 3). That is, in response to cam-shaped portion 32 being actuated to provide a reduced or decreased degree of abutting contact with nonplanar member 24, nonplanar member 24 pivots along base 12 to substantially return from distance 60 toward distance 58, or sufficiently loosening electrode-engaging portion 22 so that the battery terminal may be disengaged from a battery post. Stated another way, nonplanar member 24 permits automatic loosening of electrode-engaging portion 22 in response to pivotably actuating lever 28 from the closed position to the open position, without further manipulation of electrode-engaging portion 22.

In one embodiment, as shown in FIG. 1, base 12 includes an embossed region 34 to provide enhanced structural strength and rigidity to resist deformation in response to abutting contact with nonplanar member 24 and forces associated with pivotal movement of lever 28, loosening and tightening of electrode-engaging portion 22 and fastening member(s) 14.

As shown in FIGS. 1 and 2, base 12 is configured to selectably engage a terminal tongue, such as terminal tongue 18 of terminal 16. In one embodiment, base 12 includes a tab 20 to secure a fastening member 14, such as a bolt, to receive an aperture formed in a terminal tongue of a terminal. As further shown, a second fastening member 14 is secured to base 12, although more than two fastening members 14 may be provided by base 12. In an alternate embodiment, one or more fastening members 14 may be fixed to base 12, so that a mating fastener 66 (see FIG. 9) can be threadedly advanced and tightened onto fastening member 14 with one hand, i.e., without requiring a second hand to secure fastening member 14 from inadvertent rotation with respect to base 12. It is appreciated that fastening members 14 can be angularly disposed with respect to each other at any desired orientation, e.g., 90 degrees, parallel, etc., which may be dependent upon the particular application. That is, fastening members 14 may be oriented to ease installation of battery terminal 10, as well as any terminal blades correlating to the function of the device, such as cables associated with starting an automobile, or other electrically powered components.

Figure 6:
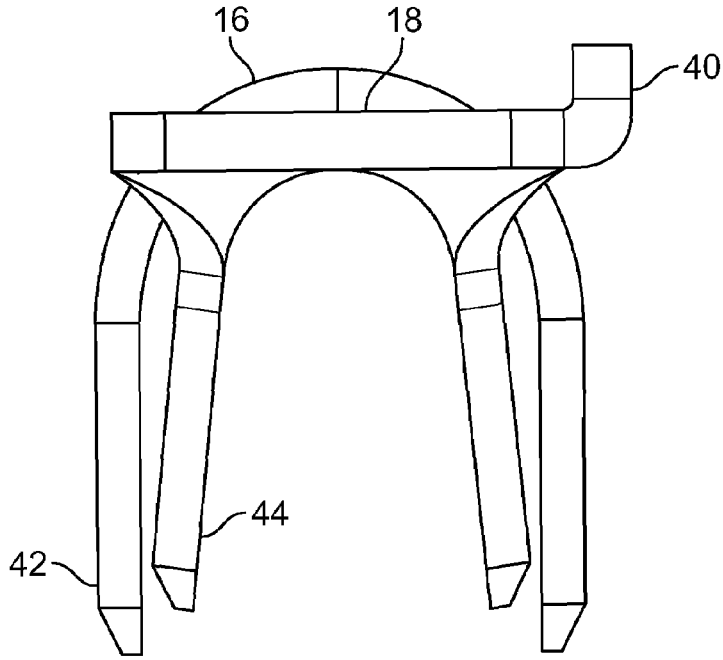
FIG. 6 is an end view of the embodiment of a terminal of FIG. 5 of the present invention.

As shown in FIGS. 1, 5 and 6, terminal 16 includes a tongue 18 having an aperture 38 for receiving a fastening member 14. Terminal 16 may include opposed flaps 42, 44 that are crimped to a cable (not shown) to provide electrical power to operate the desired component upon connection with the battery terminal. It is understood by those skilled in the art that components may have two terminals, i.e., connected to each of battery terminals corresponding to positively and negatively charged battery posts to complete an electrical circuit, although other arrangements are possible. Terminal 16 includes a tab 40 configured to be conformally secured to an end or edge of base 12 so that terminal 16 is secured at a predetermined angular orientation to each other. As shown in FIG. 1, tab 40 is disposed substantially perpendicular to tongue 18 and configured substantially parallel to the cable secured to terminal 16. This permits terminal 16 to be secured substantially perpendicular to base 12, due to tab 40 conformally engaging an edge of base 12. In other words, a cable using terminal 16 can be secured substantially perpendicular to base 12. Alternately (not shown), tab 40 may be configured to conformally engage the radial edge 68 of tab 20 (see FIG. 1) at the junction between tab 20 and base 12 so that terminal 16 may be rotated 90 degrees counterclockwise from the arrangement shown in FIG. 1, i.e., terminal 16 is substantially parallel to base 12. It is to be understood that tab 40 can be disposed at any angular orientation with respect to the cable secured by flaps 42, 44, or by similar means known in the art to secure a cable to a terminal. For terminal 16, the cable is secured substantially parallel to tongue 18, although it is contemplated that a joggle or other offsetting arrangement may be formed in terminal 16, if desired.

Figure 8:
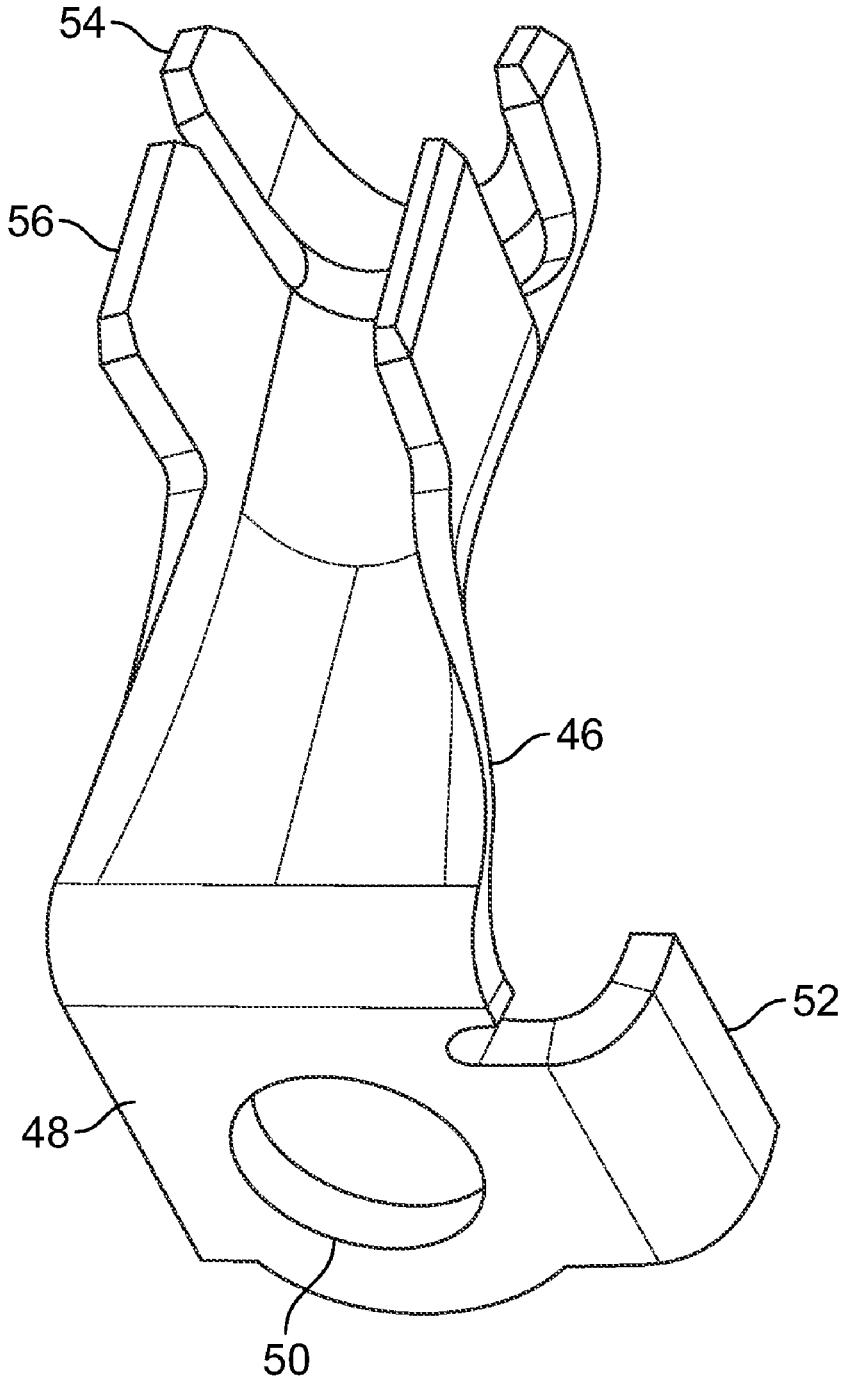
FIG. 8 is a bottom perspective view of an alternate embodiment of a terminal of the present invention.

As shown in FIG. 8, terminal 46 has a tongue 48 including an aperture 50 for achieving selective engagement with the battery terminal as previously discussed. Also, similar to terminal 16, a tab 52 is formed along a peripheral edge of tongue 48 and opposed flaps 54, 56 are formed in terminal 46. However, for terminal 46, the cable is secured substantially perpendicular to tongue 48, while for terminal 16 (FIG. 5), the cable is secured substantially parallel to tongue 18. It is to be understood that while the angular orientation shown in FIG. 8 between the cable and terminal tongue 48 is perpendicular, other angular orientations may be used.

As shown in FIG. 7, battery terminal 100, which is otherwise similar to battery terminal 10 except as shown, includes a tab 120 disposed substantially perpendicular to base 12 to secure one or more fastening members 14. In one embodiment, a set of battery terminals 10, 100 are mirror images of each other, for use with corresponding positive and negative battery posts. Also, if desired, more than two fastening members can be associated with a battery terminal construction, and that while the construction of bases 12 (FIGS. 1 and 7) are of unitary construction, base constructions can also be constructed of two or more additional members.

It is to be understood that with various embodiments of components shown and as discussed, battery terminals may be constructed that provide any number of combinations of angular orientations between the base of the battery terminal and the cables connecting thereto. Further, by virtue of at least two fastening members or similarly configured arrangements to engage terminal tongues as previously discussed, at least two terminal tongues can be separately engaged. That is, while the engagement between one fastening member, such as between a cable associated with starting an automobile, can be maintained in an engaged or fastened position, another fastening member can be actuated (engaged/disengaged) with respect to another cable associated with a totally different component by selective engagement with the corresponding terminal blade and base of the battery terminal.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A battery terminal comprising:

a base configured to selectably engage a terminal tongue;

an annular electrode-engaging portion configured to receive a battery post, one end of the electrode-engaging portion extending contiguously from the base, an opposite end of the electrode-engaging portion terminating at a nonplanar member adjacent to the base;

a lever-holding portion extending from the base toward the nonplanar member;

a lever pivotably connected to the lever-holding portion about an axis, the lever having a cam-shaped portion;

wherein in response to pivotal motion of the lever toward a closed position, the cam-shaped portion is urged into contact with the nonplanar member, the nonplanar member pivoting about an end along the base to resiliently draw the electrode-engaging portion into a gripping arrangement.

2. The battery terminal of claim 1 wherein the base includes a fastening member to engage the terminal tongue.

3. The battery terminal of claim 1 wherein the fastening member is secured to the base.

4. The battery terminal of claim 1 wherein the terminal tongue is configured to be secured substantially parallel to the base.

5. The battery terminal of claim 1 wherein the base is configured to separately engage at least two terminal tongues.

6. The battery terminal of claim 5 wherein the base includes at least two fastening members to engage the at least two terminal tongues.

7. The battery terminal of claim 6 wherein the base includes at least one tab to engage at least one of the at least two fastening members.

8. The battery terminal of claim 6 wherein the at least two fastening members are disposed substantially parallel to each other.

9. The battery terminal of claim 6 wherein the at least two fastening members are disposed at a predetermined angle to each other.

10. The battery terminal of claim 9 wherein the at least two fastening members are disposed substantially perpendicular to each other.

11. The battery terminal of claim 1 wherein the terminal tongue is configured to be secured at a predetermined angle to the base.

12. The battery terminal of claim 11 wherein the predetermined angle is substantially 90 degrees.

13. The battery terminal of claim 5 wherein at least one of the at least two terminal tongues is configured to be secured at a predetermined angle to the base.

14. The battery terminal of claim 13 wherein the predetermined angle is substantially 90 degrees.

15. The battery terminal of claim 13 wherein at least one of the at least two terminal tongues is configured to be secured substantially parallel to the base.

16. A battery terminal comprising:

a base configured to separately engage at least two terminal tongues;

an annular electrode-engaging portion configured to receive a battery post, one end of the electrode-engaging portion extending contiguously from the base, an opposite end of the electrode-engaging portion terminating at a nonplanar member adjacent to the base;

a lever-holding portion extending from the base toward the nonplanar member;

a lever pivotably connected to the lever-holding portion about an axis, the lever having a cam-shaped portion;

wherein in response to pivotal motion of the lever toward a closed position, the cam-shaped portion is urged into contact with the nonplanar member, the nonplanar member pivoting about an end along the base to resiliently draw the electrode-engaging portion into a gripping arrangement.

17. The battery terminal of claim 16 wherein the base includes at least two fastening members to engage the at least two terminal tongues.

18. The battery terminal of claim 17 wherein at least one of the at least two fastening members are secured to the base.

19. The battery terminal of claim 16 wherein at least one of the at least two terminal tongues is configured to be secured at a predetermined angle to the base.

20. The battery terminal of claim 19 wherein the predetermined angle is substantially 90 degrees.

* * * * *